US007953347B2

(12) United States Patent
Dawson et al.

(10) Patent No.: US 7,953,347 B2
(45) Date of Patent: May 31, 2011

(54) RETAINING DEVICES AND METHODS FOR RETAINING A DEVELOPER UNIT OF AN IMAGE FORMING DEVICE

(75) Inventors: Jedediah Taylor Dawson, Lexington, KY (US); Matthew Thomas Kerley, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 454 days.

(21) Appl. No.: 11/939,740

(22) Filed: Nov. 14, 2007

(65) Prior Publication Data

US 2009/0123177 A1 May 14, 2009

(51) Int. Cl.
*G03G 15/08* (2006.01)

(52) U.S. Cl. ..... 399/120; 399/262

(58) Field of Classification Search ..... 399/107, 399/110, 111, 119, 120, 252, 258, 262
See application file for complete search history.

(56) References Cited

U.S. PATENT DOCUMENTS 5,121,165 A * 6/1992 Yoshida et al. ..... 399/119
5,175,587 A * 12/1992 Kato et al. ..... 399/262
5,289,243 A * 2/1994 Sakamoto ..... 399/119
5,520,229 A * 5/1996 Yamada ..... 141/364

* cited by examiner

*Primary Examiner* — David P Porta
*Assistant Examiner* — Benjamin Schmitt

(57) ABSTRACT

The present application is directed to retainers and methods of retaining a developer unit within an image forming device. One embodiment may include positioning a retainer attached to a frame at a first position with a second end of the retainer positioned away from the developer unit. A toner cartridge may be inserted into the image forming device in a vertical direction and contact against retainer. The toner cartridge may laterally move the retainer relative to the frame from the first position to a second position with the second end positioned to prevent removal of the developer unit from the frame. Another embodiment features a system to retain a developer unit in an image forming device. The system may include a frame configured to receive the developer unit and the toner cartridge. A retainer may be movably attached to the frame and include a first end with a ramped surface, and a second end spaced away from the first end. The retainer may be movable between a first position prior to insertion of the toner cartridge with the second end positioned away from the developer unit, and a second position after insertion of the toner cartridge with the second end positioned to prevent removal of the developer unit from the frame.

8 Claims, 11 Drawing Sheets

RETAINING DEVICES AND METHODS FOR RETAINING A DEVELOPER UNIT OF AN IMAGE FORMING DEVICE

BACKGROUND

The present application is directed to devices and methods of retaining a developer unit within an image forming device and, more specifically, to movable retainers positioned within the image forming device for retaining the developer unit.

Image forming devices include copiers, laser printers, facsimile machines, and the like. These devices may include multiple imaging stations that are completely or partially removed and replaced when necessary. In particular, color devices may require up to four imaging stations. The imaging stations may include a developer unit, photoconductive unit, and a toner cartridge. The developer unit may include a developer roller, and the photoconductor unit may include a photoconductive (PC) drum. A separate toner cartridge may include a reservoir to contain the toner.

The toner is consumed during the image formation as each successive image uses an amount of toner. Once all of the toner has been consumed, the user removes all or part of the imaging station and inserts a replacement. The image forming device and the imaging unit should be constructed to provide access to the imaging station to facilitate the removal. Further, the device should provide for accurate replacement and realignment of the new imaging unit and/or component parts.

In some embodiments, the developer units, photoconductive units, and toner cartridges carefully engage together to prevent image defects and/or toner spillage. Toner may be transferred from the toner cartridge, to the developer unit, and then to the photoconductive unit. As these units may be individually removed, it may be necessary that the units attach and detach precisely. By way of example, it may be necessary for the toner cartridge to be in a closed orientation prior to being detached from the developer unit. Otherwise, toner may leak from the toner cartridge or developer unit during the detachment.

SUMMARY

The present application is directed to retainers and methods of retaining a developer unit within an image forming device. One embodiment may include positioning a retainer attached to a frame at a first position with a second end of the retainer positioned away from the developer unit. A toner cartridge may be inserted into the image forming device in a vertical direction and contact against retainer. The toner cartridge may laterally move the retainer relative to the frame from the first position to a second position with the second end positioned to prevent removal of the developer unit from the frame.

Another embodiment features a system to retain a developer unit in an image forming device. The system may include a frame configured to receive the developer unit and the toner cartridge. The frame may include an upper side and a lower side. A retainer may be movably attached to the frame and include a first end with a ramped surface, and a second end spaced away from the first end. The retainer may be movable between a first position prior to insertion of the toner cartridge with the second end positioned away from the developer unit, and a second position after insertion of the toner cartridge with the second end positioned to prevent removal of the developer unit from the frame.

DETAILED DESCRIPTION

Figure 1:
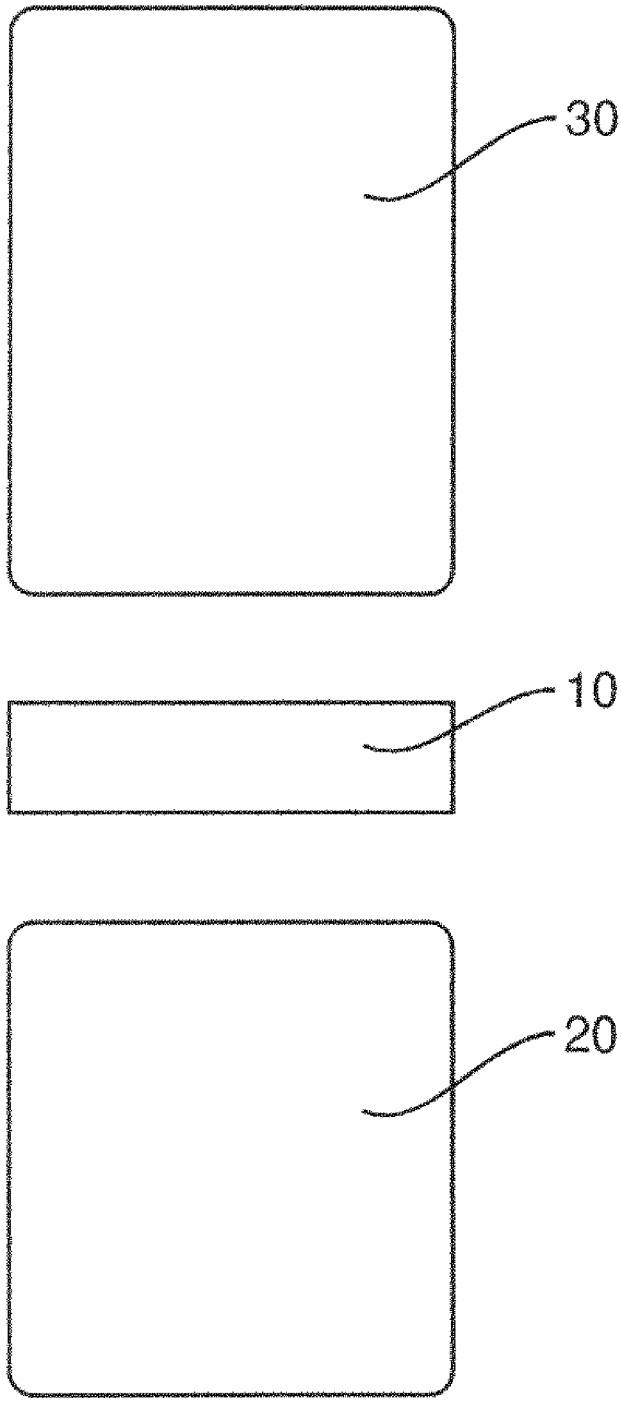
FIG. 1 is a schematic diagram of a retainer, developer unit, and a toner cartridge according to one embodiment.

The present application is directed to retainers and methods for retaining an element within an image forming device. FIG. 1 schematically illustrates one embodiment of the retainer 10 operatively positioned relative to a developer unit 20 and a toner cartridge 30. The retainer 10 is movable between a first position that allows removal and of the developer unit 20, and a second position that prevents removal and maintains the position of the developer unit 20. The movement of the retainer 10 is controlled by the toner cartridge 30. When the toner cartridge 30 is removed from the image forming device, the retainer 10 is in the first position. When the toner cartridge 30 is installed within the image forming device, the retainer 10 is in the second position.

Figure 2:
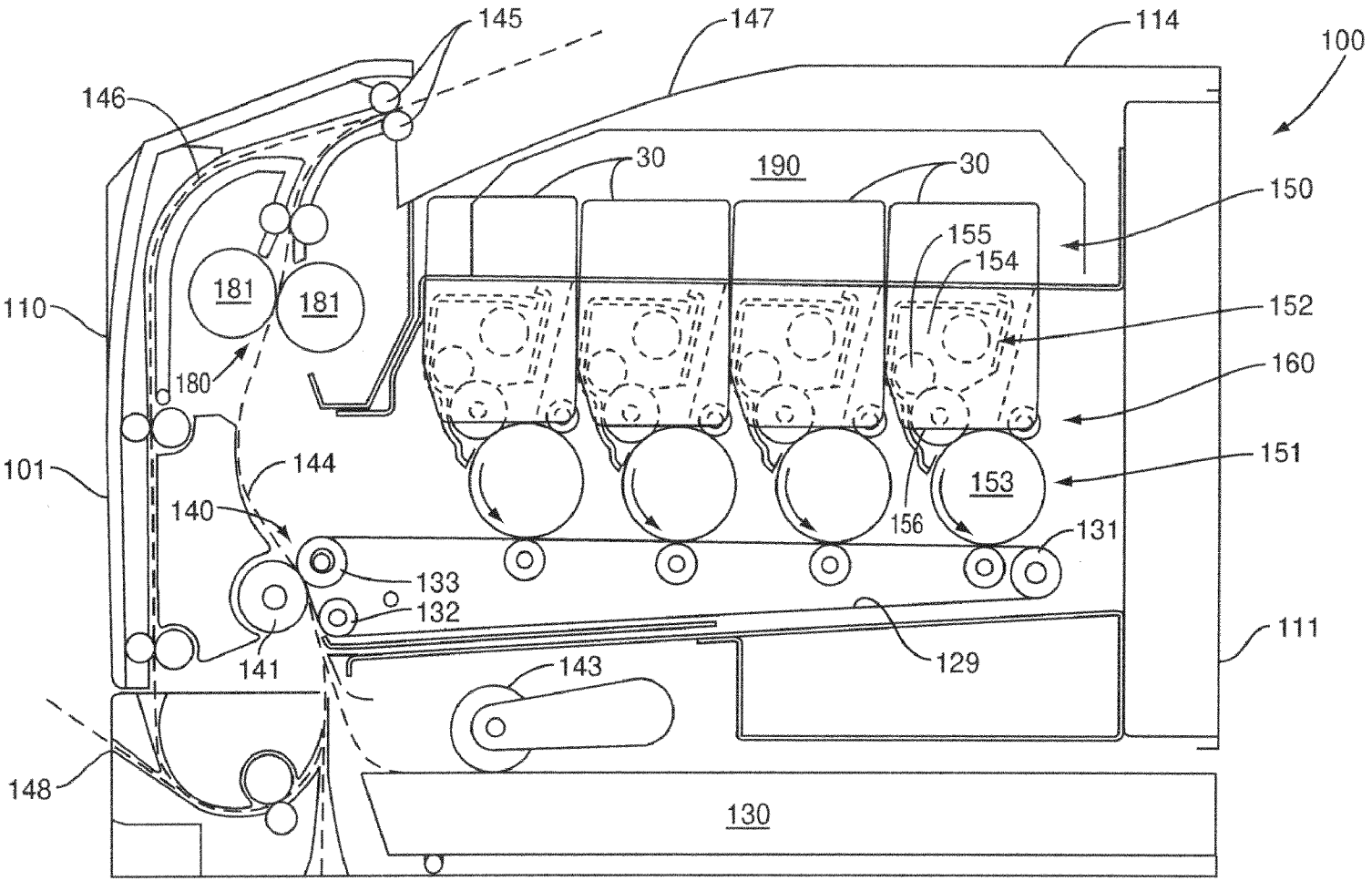
FIG. 2 is a side schematic view of an image forming device according to one embodiment.

To better understand the context in which the retainer 10 functions, an overall understanding of an image forming device 100 is beneficial. FIG. 2 illustrates one embodiment of an image forming device 100. The device 100 includes a first toner transfer area 160 with one or more imaging stations 150 that are aligned horizontally extending from the front 110 to the back 111 of the body 101. Each imaging station 150 includes a photoconductor unit 151 and a developer unit 152. For purposes of clarity, the units 151, 152 are labeled on only one of the imaging stations 150. In one embodiment, each of the imaging stations 150 is substantially the same except for the color of toner.

The developer unit 152 includes a toner reservoir 154 to contain the toner. One or more agitating members may further be positioned within the reservoir 154 to move the toner. Developer unit 152 further includes a toner adder roller 155 that moves the toner from the reservoir 154 to a developer roller 156. The photoconductor unit 151 includes in part a charging roller and a PC drum 153.

During image formation, the surface of the PC drum 153 is charged to a specified voltage such as −1000 volts, for example. A laser beam from a printhead 190 is directed to the surface of the PC drum 153 and discharges those areas it contacts to form a latent image. In one embodiment, areas on the PC drum 153 illuminated by the laser beam are discharged to approximately −300 volts. The developer roller 156 then transfers toner to the PC drum 153 to form a toner image. The toner is attracted to the areas of the PC drum 153 surface discharged by the laser beam from the printhead 190.

An intermediate transfer mechanism (ITM) 129 is disposed adjacent to each of the imaging stations 150. In this embodiment, the ITM 129 is formed as an endless belt trained about drive roller 131, tension roller 132 and back-up roller 133. During image forming operations, the ITM 129 moves past the imaging stations 150 in a clockwise direction as viewed in FIG. 2. One or more of the PC drums 153 apply toner images in their respective colors to the ITM 129. In one embodiment, a positive voltage field attracts the toner image from the PC drums 153 to the surface of the moving ITM 129.

The ITM 129 rotates and collects the one or more toner images from the imaging stations 150 and then conveys the toner images to a media sheet at a second transfer area. The second transfer area includes a second transfer nip 140 formed between the back-up roller 133 and a second transfer roller 141.

A media path 144 extends through the device 100 for moving the media sheets through the imaging process. Media sheets are initially stored in an input tray 130 or introduced into the body 101 through a manual feed 148. The media sheet receives the toner image from the ITM 129 as it moves through the second transfer nip 140. The media sheets with toner images are then moved along the media path 144 and into a fuser area 180. Fuser area 180 includes fusing rollers or belts 181 that form a nip to adhere the toner image to the media sheet. The fused media sheets then pass through exit rollers 145 that are located downstream from the fuser area 180. Exit rollers 145 may be rotated in either forward or reverse directions. In a forward direction, the exit rollers 145 move the media sheet from the media path 144 to an output area 147. In a reverse direction, the exit rollers 145 move the media sheet into a duplex path 146 for image formation on a second side of the media sheet.

Figure 3:
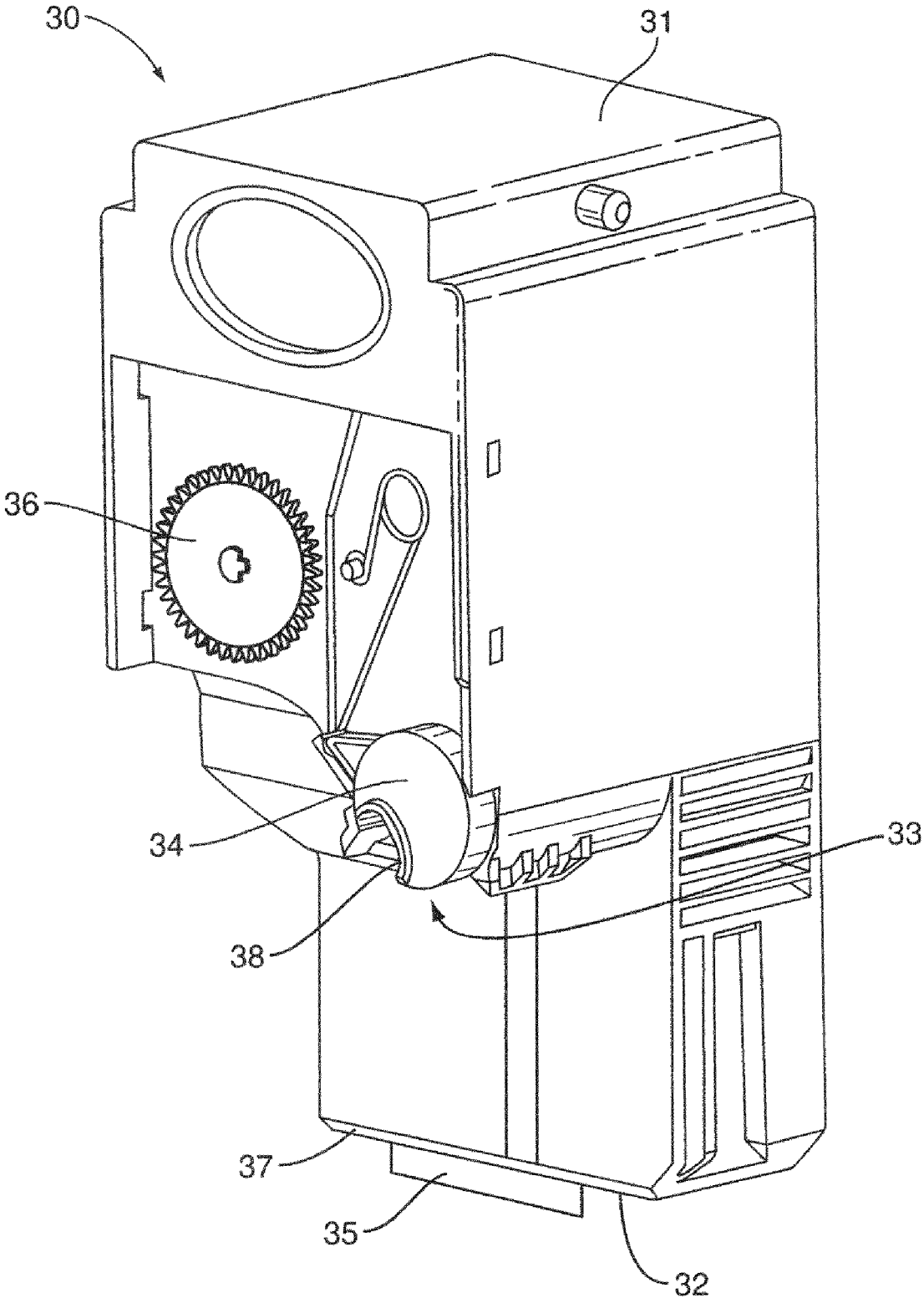
FIG. 3 is a perspective view of a toner cartridge according to one embodiment.

A toner cartridge 30 may be attachable to the developer unit 152 to supply toner to the reservoir 154. FIG. 3 illustrates one embodiment of a toner cartridge 30 that can be operatively connected to the developer unit 152. Toner cartridge 30 includes a top side 31 and a bottom side 32. The bottom side 32 may include an angled edge 37 that contacts against the retainer 10 during insertion. In one embodiment, the angled edge 37 is positioned at about a 45° angle. Toner is stored within the interior and is expelled through an outlet 33. A shutter 34 is positioned within the outlet 33 to control the movement of the toner. Shutter 34 may be rotated between a closed orientation to prevent toner movement and an open orientation to allow toner to move through the outlet 33 and into an inlet in the developer unit 152. The shutter 34 includes a notch 38 that engages with the developer unit 152 to move the shutter 34 between the open and closed orientations. A gear 36 is positioned to engage with a corresponding gear on the developer unit 152. Gear 97 is operatively connected to members within the interior to agitate and move the toner through the outlet 33. In one embodiment, an electrical connector 35 is positioned at the bottom side 32 and engages with a connector in the body 101 of the image forming device 100, or the imaging units 200. Examples of toner cartridges are disclosed in U.S. patent application Ser. Nos. 11/554,157 and 11/554,117 each filed on Oct. 30, 2006 and each incorporated herein by reference.

Figure 4:
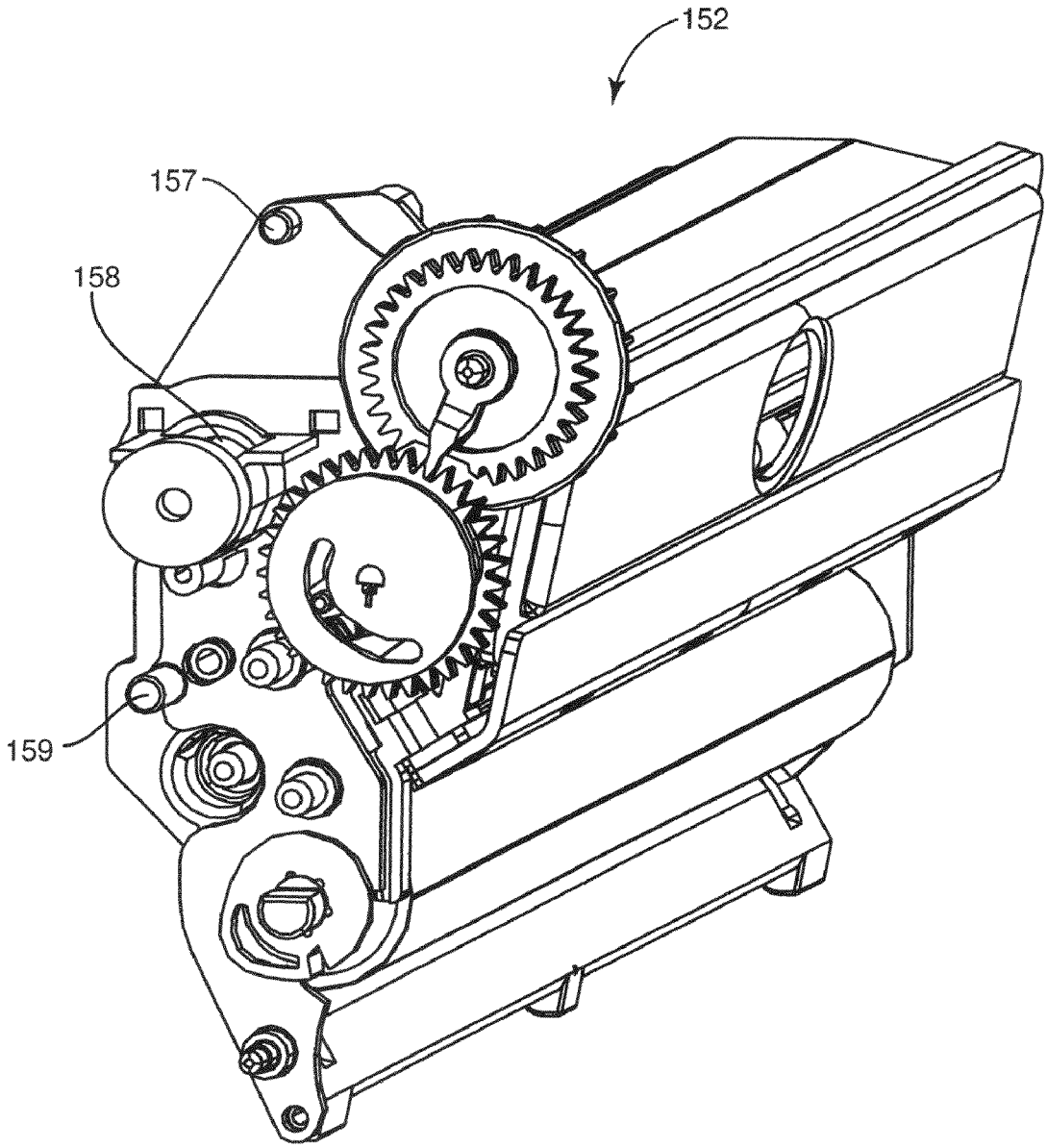
FIG. 4 is a perspective view of a developer unit according to one embodiment.

The developer unit 152 is positioned to engage with the toner cartridge 30. FIG. 4 illustrates one embodiment of the developer unit 152 that includes a receptacle 158 that aligns with and receives toner from the outlet 33 of the toner cartridge 30. The developer unit 152 also includes a pin 157 positioned to engage with the notch 38 in the shutter 34. During insertion of the toner cartridge 30, the pin 157 fits within notch 38 causing the shutter 34 to rotate from the closed orientation to the open orientation. During removal of the toner cartridge 30, the pin 30 contacts against the notch 38 and causes the shutter 34 to rotate to the closed orientation. The developer unit 152 also includes a retaining post 159 that extends outward beyond one end. The retaining post 159 interacts with the retainer 10 as will be explained in detail below. One embodiment of a toner cartridge and shutter arrangement is disclosed in U.S. patent application Ser. No. 11/686,614 herein incorporated by reference.

Figure 5A:
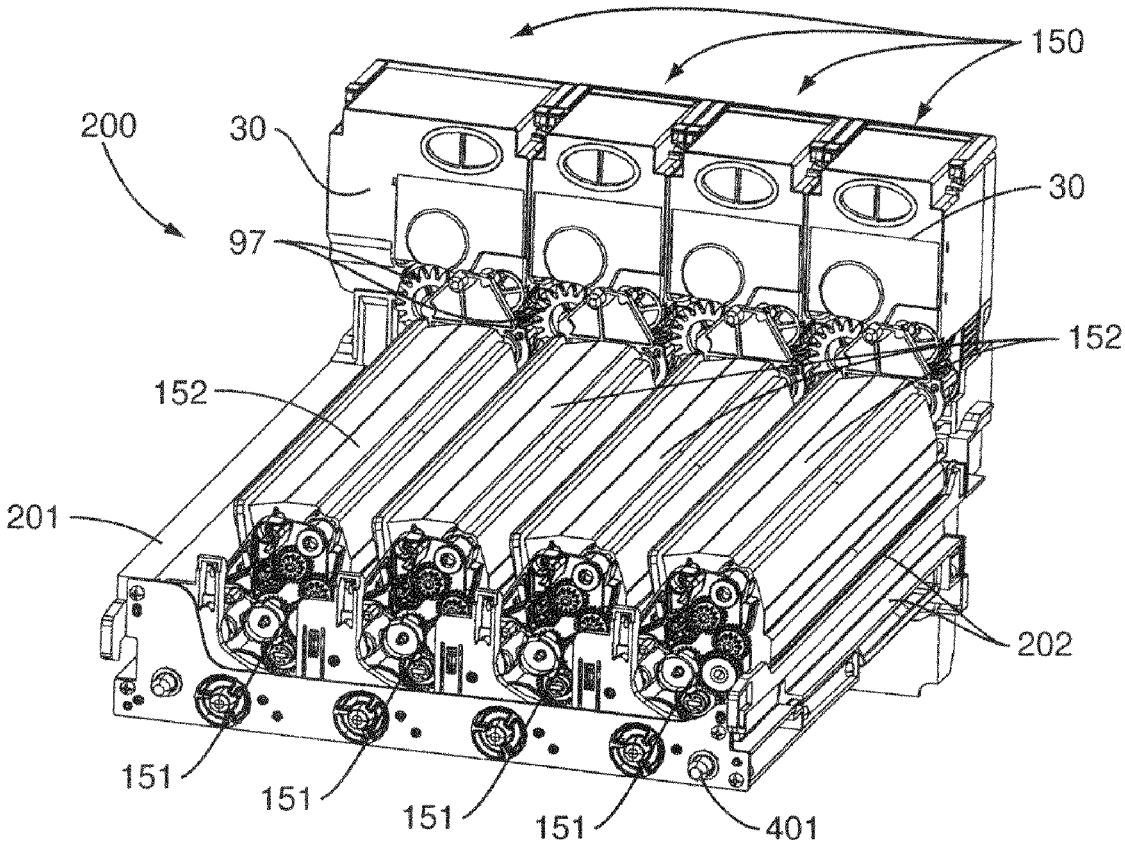
FIG. 5A is a perspective view of a first side of an imaging unit according to one embodiment.
Figure 5B:
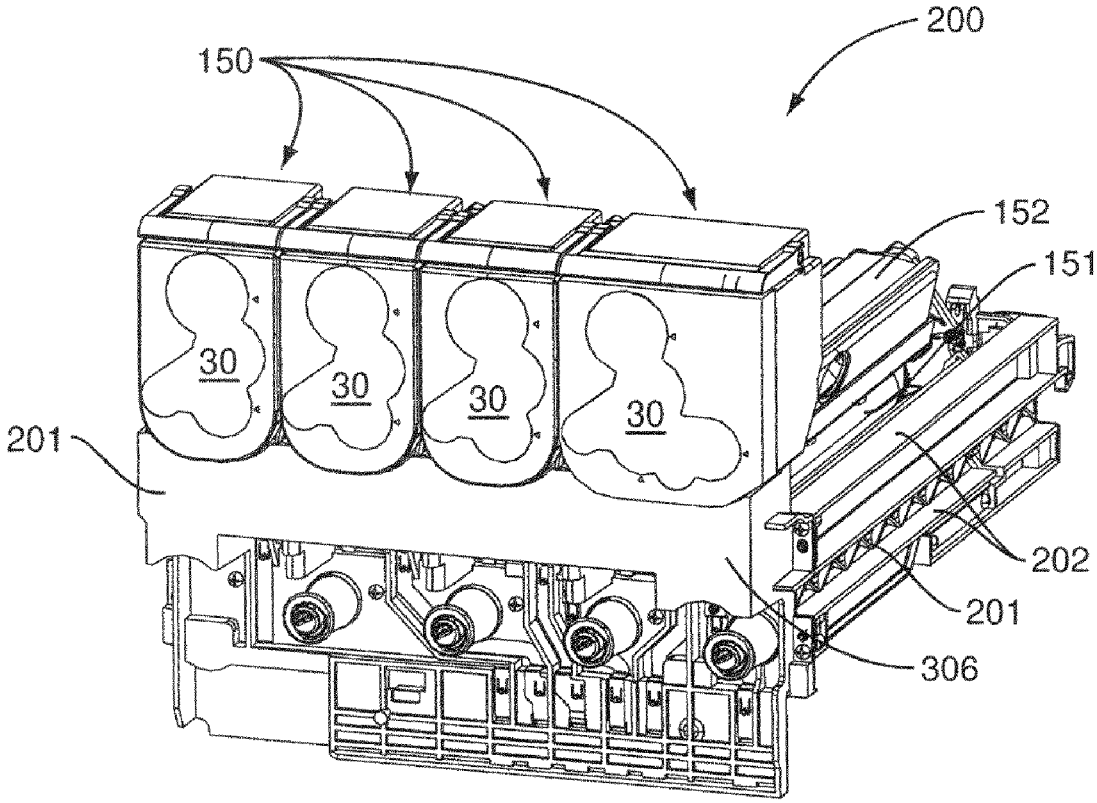
FIG. 5B is a perspective view of a first side of an imaging unit according to one embodiment.

Two or more imaging stations 150 are mounted together to form the imaging unit 200. FIGS. 5A and 5B illustrate an imaging unit 200 that includes four imaging stations 150 that each includes a photoconductor unit 151, developer unit 152, and a toner cartridge 30. The imaging unit 200 includes a frame 201 sized to receive each of the imaging stations 150. Frame 201 includes a substantially rectangular shape formed by opposing first and second brace members and lateral brace members. In one embodiment, the brace members are manufactured out of stamped metal plates that result in precise control of the location of the PC drums 153 relative to one another and relative to the ITM belt 129, laser assembly 190, and drive modules within the body 101. In one embodiment, brace members are constructed of plastic. Frame 201 includes a central opening sized to receive the photoconductor units 151 and developer units 152. One or more guide rails 202 extend along the frame 201 to facilitate insertion of the imaging unit 200 into the body 101.

Figure 6:
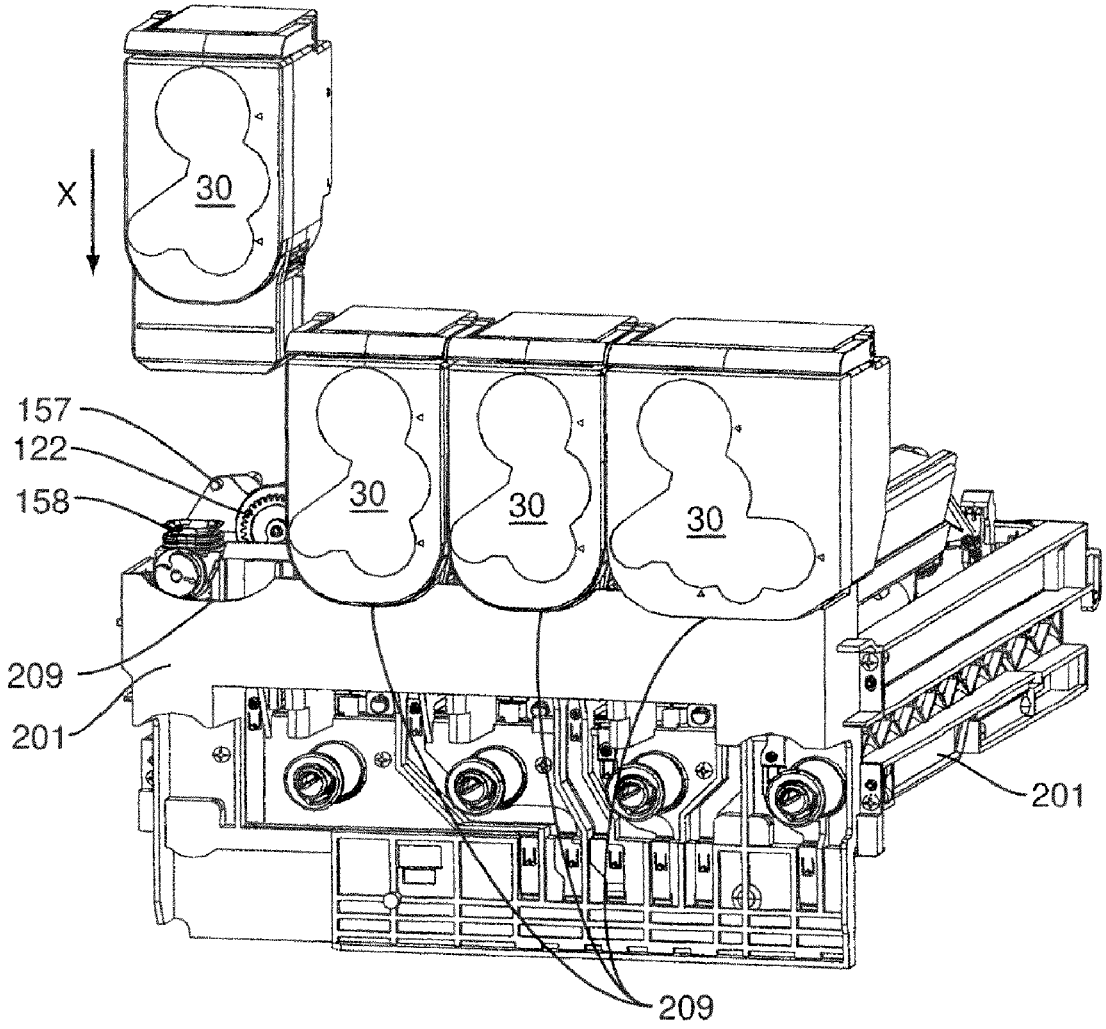
FIG. 6 is a perspective view of a toner cartridge being inserted onto an imaging unit according to one embodiment.

In one embodiment as illustrated in FIG. 6, the toner cartridges 30 are mounted to the frame 201 in a vertical direction X. The frame 201 includes one or more cut-outs 209 each sized to receive one of the cartridges 30. Once fully seated, the electrical connector 35 is engaged with the corresponding connector in the body 101 or within the frame 201. Further, the pin 157 on the developer unit 152 is positioned to contact notch 38 of the shutter 34 and rotate the shutter 34 from the closed orientation to the open orientation as the toner cartridge 30 is being fully seated onto the frame 201. Once seated, the outlet 35 is aligned with the receptacle 158 in the developer unit 152 to receive the toner.

One issue with this structure is the developer unit 152 may move during removal of the toner cartridge 30. The upward force (i.e., in a direction opposite arrow X of FIG. 6) applied to the toner cartridge 30 during removal may unseat the developer unit 152 from the frame 201 of the imaging unit 200. Further, the actuation of the shutter 34 on the toner cartridge 30 is dependent on contact with the developer unit 152. The shutter 34 may not fully close when the developer unit 152 is out of position as the pin 157 may not engage with the notch 38.

Figure 7:
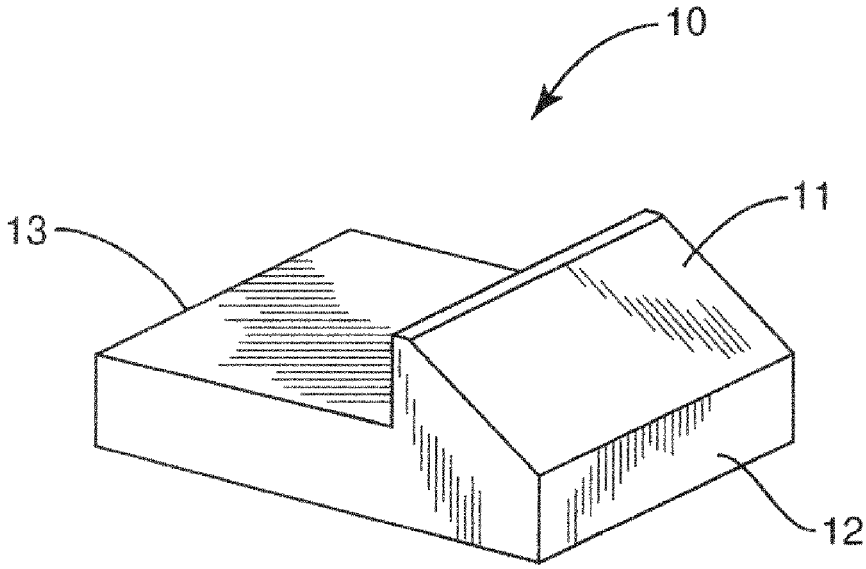
FIG. 7 is a perspective view of a retainer according to one embodiment.

The retainer 10 is mounted on the frame 201 to engage with and maintain the position of the developer unit 152. FIG. 7 illustrates one embodiment of the retainer 10 that includes an elongated body with a first end 12 and a second end 13. A ramped surface 11 is positioned in proximity to the first end 12 to contact with the developer unit 152 as will be explained below. In one embodiment, the ramped surface 11 is positioned at about a 45° angle.

Figure 8:
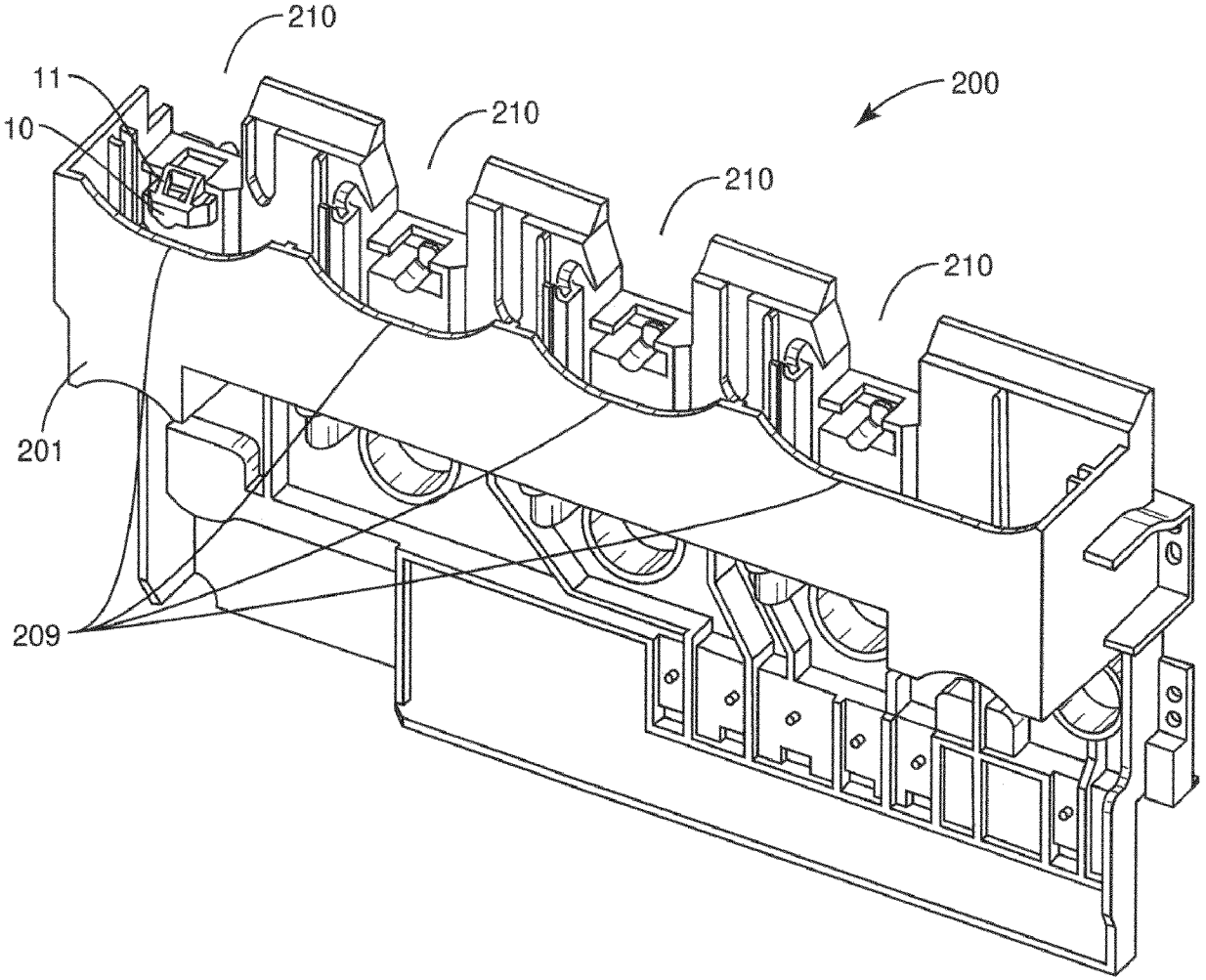
FIG. 8 is a perspective view of a retainer attached to a frame according to one embodiment.

FIG. 8 illustrates an embodiment with the retainer 10 mounted to the frame 201 of the imaging unit 200. For clarity, the PC units 151 and developer units 152 and the remainder of the frame 201 have been removed. The retainer 10 is positioned within a receptacle 210 that receives one of the toner cartridges 30.

Figure 9:
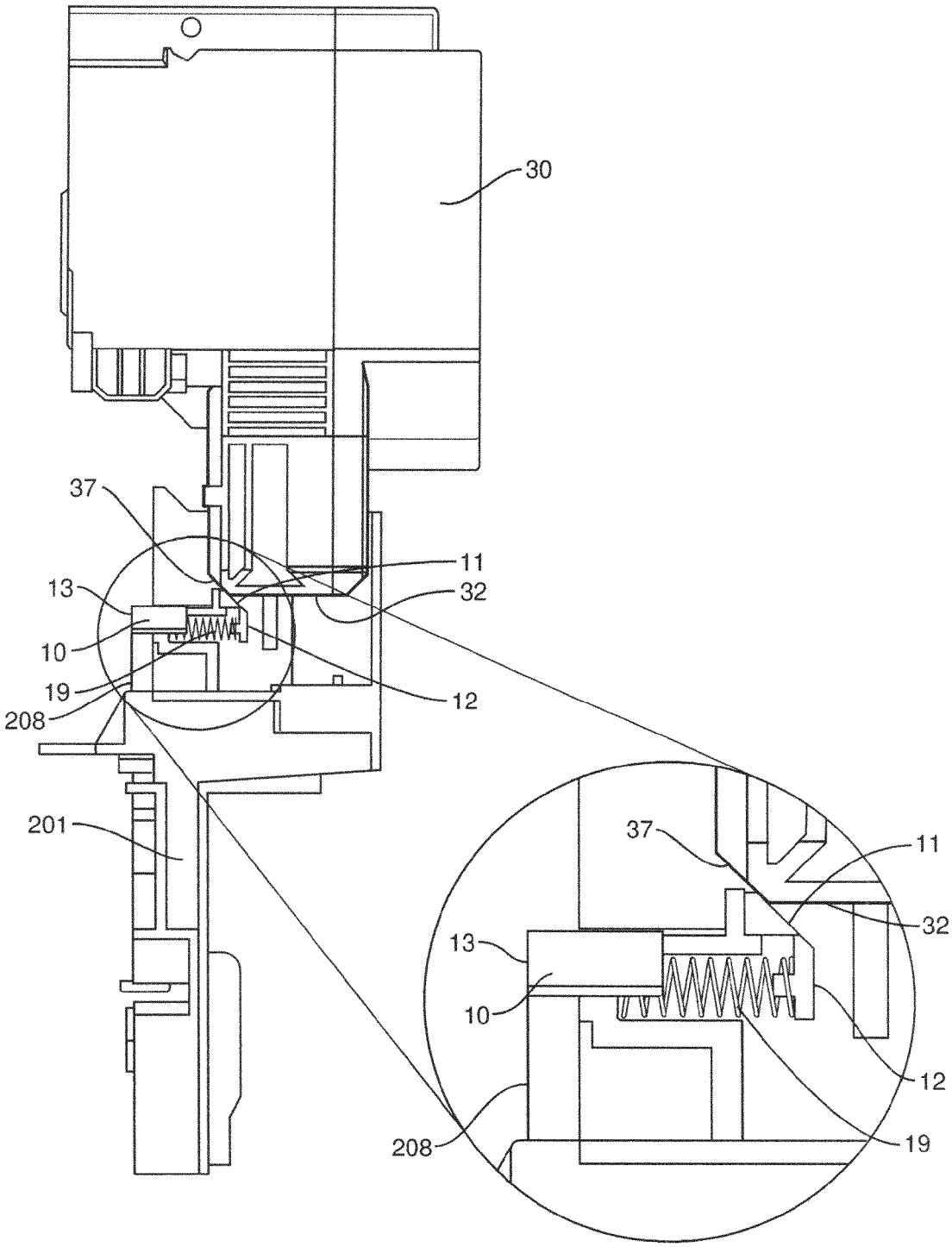
FIG. 9 is a side view of a retainer in a first position according to one embodiment.

The retainer 10 is positioned on the frame 201 to be movable between first and second positions. FIG. 9 illustrates an embodiment with the retainer 10 in a first position. The retainer 10 assumes the first position prior to insertion of the toner cartridge 30. As illustrated in FIG. 9, the toner cartridge 30 is not yet inserted into the image forming device 100. When the retainer 10 is in the first position, the second end 13 is substantially aligned with an inner edge 208 of the frame 201. In this embodiment, a biasing member 19 is attached between the retainer 10 and the frame 201 to bias the retainer 10 towards the first position.

Figure 10:
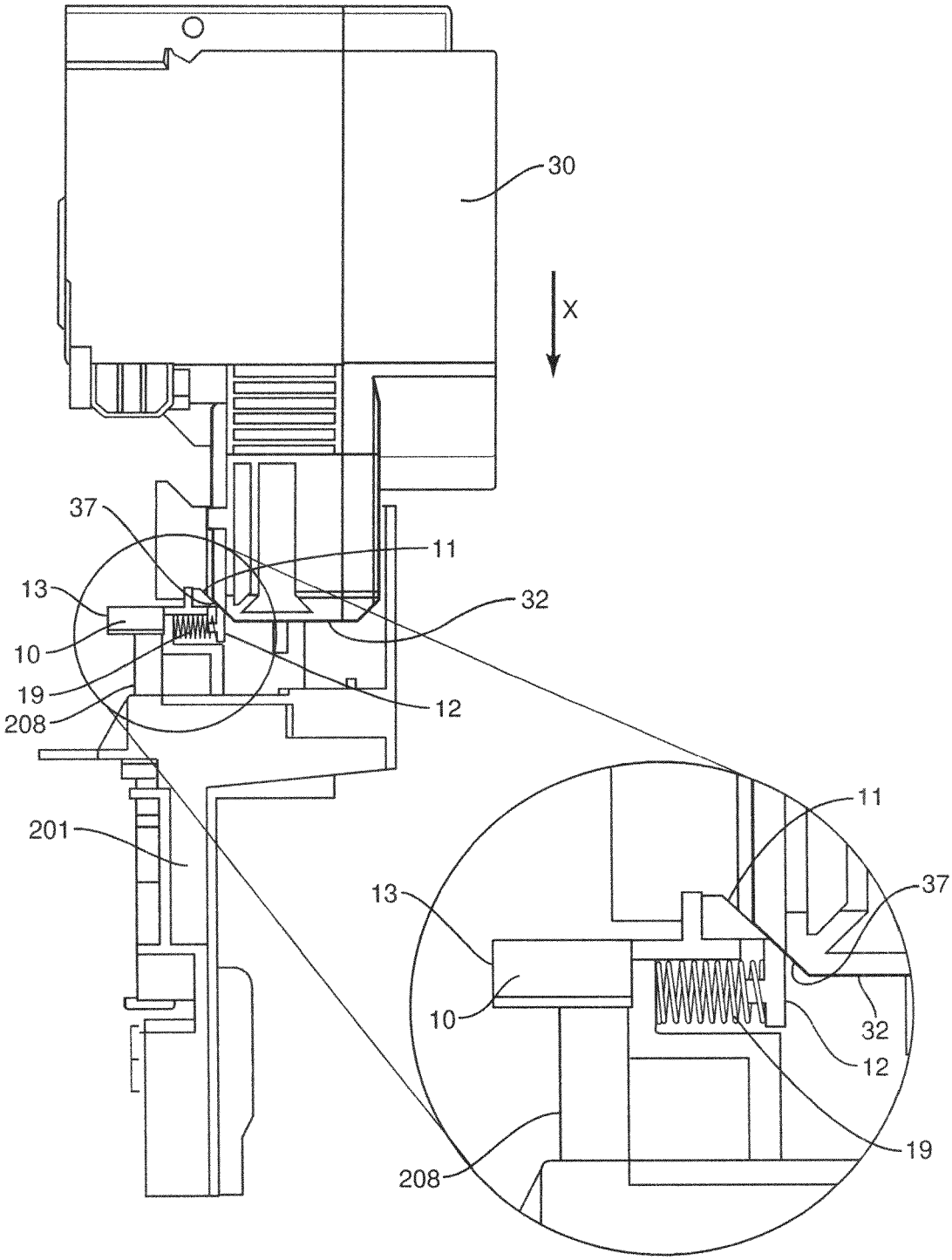
FIG. 10 is a side view of a retainer in a second position according to one embodiment.

FIG. 10 illustrates the toner cartridge 30 inserted in the direction of arrow X forcing the retainer 10 in the second position. The retainer 10 has moved relative to the frame 201 and the second end 13 now extends outward beyond the inner edge 208 of the frame 201. This movement is caused by the contact of the angled surface 37 of the toner cartridge 30 against the ramped surface 11 of the retainer 10. As the toner cartridge 30 is vertically inserted in the direction X, the angled surface 39 contacts against the ramped surface 11. This contact transforms the vertical motion of the inserted toner cartridge 30 into horizontal motion of the retainer 10. The body of the toner cartridge 30 remains in contact with the first end 12 of the retainer 10 to maintain the retainer 10 in the second position.

The retainer 10 extends over at least a portion of the developer unit 152 when in the second position. This positioning prevents the developer unit 152 from moving during removal of the toner cartridge 30. In one embodiment, the retainer 10 extends over the retention post 159 that extends outward from the end of the developer unit 152. The retainer 10 maintains the developer unit 152 in the imaging unit 350 to assist in actuation of the shutter 34. The retainer 10 remains in the second position until the shutter 34 rotates to the closed orientation prior to moving to the first position. This prevents toner from leaking from the toner cartridge 30.

Figure 11:
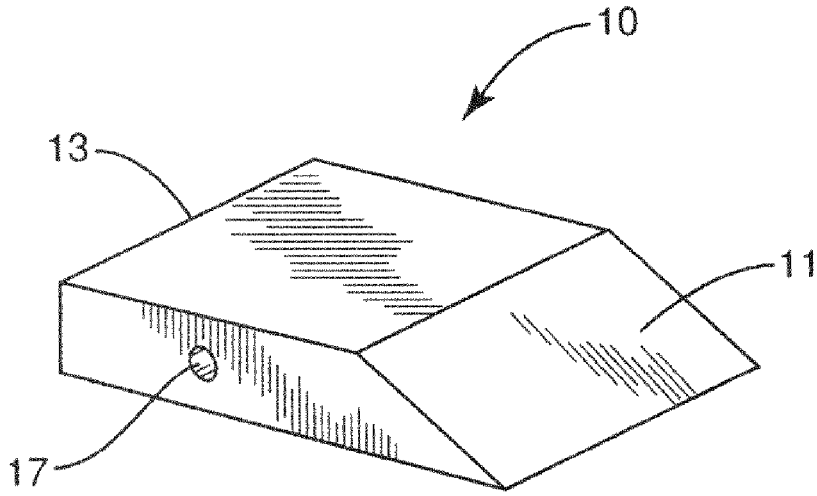
FIG. 11 is a perspective view of a retainer according to one embodiment.

In one embodiment as illustrated in FIG. 7, the retainer 10 slides between the first and second positions. In another embodiment as illustrated in FIG. 11, the retainer 10 includes a pivot 17 to pivotally move between the first and second positions. The retainer 10 is attached to the frame 201 with the ramped surface 11 positioned to contact the toner cartridge 30. During insertion, the toner cartridge 30 contacts against the ramped surface 11 causing the retainer 10 to move about the pivot 17 causing the second end 13 to extend over a section of the developer unit 152. After the toner cartridge 30 is removed, the retainer 10 again moves about the pivot 17 and returns to the first position. A biasing member (not illustrated) may be operatively connected to the retainer 10 to bias the retainer 10 towards the first position.

Once the imaging unit 200 is mounted within the body 101, the toner cartridges 30 are positioned to be vertically removed and replaced without removing the imaging unit 200 from the body 101. As explained above with reference to FIG. 6, the vertical insertion direction X engages the toner cartridge 30 with the imaging unit 200 and body 101 and provides for toner to move from the toner cartridge 30 and into the developer unit 152.

In one embodiment, each of the toner cartridges 30 is approximately the same shape and size. In another embodiment as illustrated in FIGS. 5A, 5B, and 6, one of the toner cartridges 30 is larger. The larger cartridge 30 is able to contain a larger amount of toner. In one embodiment, the black toner cartridge 30 is larger than the others because more black toner is normally used than the remaining toner colors of magenta, cyan, and yellow. This disproportionate usage may be further amplified when the image forming device 100 includes a black-only print mode with toner images only being printed from black toner. The non-black toner cartridges may be substantially identical.

In one embodiment, the imaging stations 150 include independent photoconductor units 151 and developer units 152. These units may be separated from each other, and removed separately from the imaging unit 200. In another embodiment, the units 151, 152 are both contained within a single cartridge and cannot be separated from each other, or removed separately from the imaging unit 200. In this structure, the retainer 10 maintains both units 151, 152 within the imaging unit 200.

The embodiments disclosed above are directed to image forming devices 100 with a secondary-transfer area. These devices include a first transfer of the toner image to an ITM 129, and a second transfer from the intermediate member to the media sheet. The present application may also be used in a direct transfer device that transfers the toner image directly to the media sheet (i.e., there is no intermediate member or second transfer).

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. When the retainer 10 is in the first position, the developer unit 152 may be removed from the imaging unit 200. In the embodiments described above, the retainer 10 maintains a developer unit 152. In other embodiments. The present embodiments are, therefore, to be considered in all respects as illustrative and not restrictive, and all changes coming within the meaning and equivalency range of the appended claims are intended to be embraced therein.

What is claimed is:

1. A method of retaining a developer unit in an image forming device comprising:

positioning a retainer attached to a frame at a first position with a second end of the retainer positioned away from the developer unit;

inserting a toner cartridge into the image forming device in a vertical direction and contacting the toner cartridge against retainer;

horizontally moving the retainer relative to the frame from the first position to a second position with the second end positioned to prevent removal of the developer unit from the frame; and aligning the second end of the retainer with an edge of the frame when the retainer is in the first position, and positioning the second end outward beyond the edge of the frame when the retainer is in the second position.

2. A system to retain a developer unit in an image forming device after insertion of a toner cartridge, the system comprising:

a frame configured to receive the developer unit and the toner cartridge, the frame including a vertically upper side and a lower side;

a retainer movably attached to the frame and including a first end with a ramped surface, and a second end spaced away from the first end, the retainer positioned with the ramped surface facing towards the upper side;

the retainer movable between a first position prior to insertion of the toner cartridge with the second end positioned away from the developer unit, and a second position after insertion of the toner cartridge with the second end positioned to prevent removal of the developer unit from the frame, wherein the developer unit further includes a retention member that extends outward from the developer unit and is positioned vertically below the retainer when the retainer is in the second position.

3. The system of claim 2, further comprising a passive biasing member positioned relative to the frame and the retainer to bias the retainer towards the first position.

4. The system of claim 2, wherein the ramped surface includes an angle of about 45 degrees.

5. The system of claim 2, wherein the retainer is movably attached to the frame to limit movement in a horizontal direction.

6. The system of claim 2, wherein the retainer further includes a pivot positioned between the first end and the second end.

7. the system of claim 2, wherein the retention member extends outward from an end of the developer unit.

8. The system of claim 2, wherein the retainer moves from the first position to the second position in direct response to contact with the toner cartridge during insertion thereof.

* * * * *